US012729891B2

(12) United States Patent
Su et al.

(10) Patent No.: US 12,729,891 B2
(45) Date of Patent: Sep. 8, 2026

(54) FALLING FILM EVAPORATOR

(71) Applicants: York (Wuxi) Air Conditioning and Refrigeration Co., Ltd., Wuxi (CN); Tyco Fire & Security GmbH, Neuhausen am Rheinfall (CH)

(72) Inventors: Xiuping Su, Wuxi (CN); Lu Mei, Wuxi (CN); Xiaokui Ma, Wuxi (CN); Li Wang, Wuxi (CN)

(73) Assignees: York (Wuxi) Air Conditioning and Refrigeration Co., Ltd., Wuxi (CN); Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 18/695,757

(22) PCT Filed: Aug. 29, 2022

(86) PCT No.: PCT/CN2022/115502

§ 371 (c)(1),
(2) Date: Mar. 26, 2024

(87) PCT Pub. No.: WO2023/045707

PCT Pub. Date: Mar. 30, 2023

(65) Prior Publication Data

US 2024/0401852 A1 Dec. 5, 2024

(30) Foreign Application Priority Data

Sep. 26, 2021 (CN) ..... 202111126753.3

(51) Int. Cl.
*F25B 39/02* (2006.01)
*F28D 5/02* (2006.01)
(Continued)

(52) U.S. Cl.
CPC ..... *F25B 39/028* (2013.01); *F25B 39/02* (2013.01); *F28D 5/02* (2013.01); *F28D 7/16* (2013.01);
(Continued)

(58) Field of Classification Search
CPC ..... F25B 39/028; F25B 2339/021; F25B 2339/0242; F28F 2009/224; F28F 9/22;
(Continued)

(56) References Cited

FOREIGN PATENT DOCUMENTS

CH 190843 A 5/1937
CN 104623987 A 5/2015
(Continued)

OTHER PUBLICATIONS

Machine Translation JP6880277 (Year: 2021).*
PCT International Search Report for PCT Application No. PCT/CN2022/115502, mailed Nov. 30, 2022, 3 pgs.

*Primary Examiner* — Joseph F Trpisovsky
(74) *Attorney, Agent, or Firm* — Fletcher Yoder, PC

(57) ABSTRACT

A falling film evaporator includes a housing defining an accommodating cavity and a cover provided in the accommodating cavity. The cover defines a cover accommodating cavity having a lower cover opening. The falling film evaporator further includes a gas flow channel located between the housing and the cover and enabling the lower cover opening to be in communication with a gas outlet provided at an upper portion of the accommodating cavity, and a plurality of flow guide members arranged in the gas flow channel along a height direction of the housing, where, in the height direction, one of two adjacent flow guide members is connected to the housing and is separated from the cover by a first distance, and the other of the two adjacent flow guide members is connected to the cover and is separated from the housing by a second distance.

15 Claims, 5 Drawing Sheets

(51) Int. Cl.
*F28D 7/16* (2006.01)
*F28F 9/22* (2006.01)

(52) U.S. Cl.
CPC . *F25B 2339/021* (2013.01); *F25B 2339/0242* (2013.01); *F28F 9/22* (2013.01); *F28F 2009/224* (2013.01)

(58) Field of Classification Search
CPC .. F28F 13/06; F28D 5/02; F28D 7/163; F28D 7/1632; F28D 3/02
See application file for complete search history.

(56) References Cited

FOREIGN PATENT DOCUMENTS

| | | | | |
|---|---|---|---|---|
| CN | 204648763 | U | 9/2015 | |
| CN | 205669508 | U | 11/2016 | |
| CN | 106766398 | A | 5/2017 | |
| CN | 206142859 | U | 5/2017 | |
| CN | 106969555 | A | 7/2017 | |
| CN | 206587499 | U | 10/2017 | |
| CN | 107970733 | A | 5/2018 | |
| CN | 109357441 | A | 2/2019 | |
| CN | 209060810 | U | 7/2019 | |
| CN | 209524656 | U | 10/2019 | |
| CN | 209612413 | U | 11/2019 | |
| CN | 112138470 | A | 12/2020 | |
| CN | 212431408 | U | 1/2021 | |
| CN | 113790619 | A | 12/2021 | |
| JP | 2002028421 | A | 1/2002 | |
| JP | 2014020755 | A | 2/2014 | |
| JP | 6880277 | B1 * | 6/2021 | ..... F28F 9/22 |

* cited by examiner

FALLING FILM EVAPORATOR

CROSS-REFERENCE TO RELATED APPLICATIONS

This application is a U.S. National Stage Application of PCT Application No. PCT/CN2022/115502, entitled "FALLING FILM EVAPORATOR," filed Aug. 29, 2022, which claims priority to and the benefit of Chinese Patent Application No. 202111126753.3, filed Sep. 26, 2021, each of which is herein incorporated by reference in its entirety for all purposes.

TECHNICAL FIELD

The present application relates to the field of evaporators, and in particular to a falling film evaporator.

BACKGROUND ART

In the prior art, a falling film evaporator is an evaporator with relatively high heat exchange efficiency. A heat exchange tube bundle and a plurality of baffles are arranged in the falling film evaporator. After exchanging heat with the heat exchange tube bundle, a liquid refrigerant evaporates into gas, and carries, in a flow process, the refrigerant liquid to move together. The refrigerant gas carries the refrigerant liquid to pass through the plurality of baffles, and gas-liquid separation is performed in a process of passing through the plurality of baffles, thereby making gas discharged from the falling film evaporator.

However, the arrangement of the plurality of baffles has a limited gas-liquid separation effect. Therefore, a falling film evaporator is required to improve the gas-liquid separation effect without increasing the volume of the falling film evaporator.

SUMMARY OF THE INVENTION

In order to achieve the foregoing object, the present application provides a falling film evaporator. The falling film evaporator comprises a housing, a gas outlet, a cover, a gas flow channel, and a plurality of flow guide members. The housing has a length direction and a height direction, and the housing defines an accommodating cavity. The gas outlet is provided at the upper portion of the accommodating cavity. The cover is provided in the accommodating cavity and defines a cover accommodating cavity, the cover accommodating cavity has a lower cover opening located below, and the cover accommodating cavity is configured to accommodate at least one part of a heat exchange tube bundle. The gas flow channel is located between the housing and the cover and enables the lower cover opening of the cover accommodating cavity to be in communication with the gas outlet. The plurality of flow guide members are arranged in the gas flow channel along the height direction of the housing. Here, in the height direction of the housing, one of two adjacent flow guide members is connected to the housing and is separated from the cover by a certain distance, and the other of the two adjacent flow guide members is connected to the cover and is separated from the housing by a certain distance.

According to the foregoing falling film evaporator, in the height direction of the housing, two adjacent flow guide members at least partially overlap.

According to the foregoing falling film evaporator, each of the plurality of flow guide members comprises an overlapping portion and a non-overlapping portion. The overlapping portion is a portion that overlaps an adjacent flow guide member in the height direction. An area of the overlapping portion is larger than that of the non-overlapping portion.

According to the foregoing falling film evaporator, flow guide members, which are located at the lowermost portion, among the plurality of flow guide members are connected to the housing and are separated from the cover by a certain distance.

According to the foregoing falling film evaporator, the flow guide member comprises a flow guide portion, the flow guide portion has a free end and a connecting end, the connecting end is connected to the housing or the cover, and the free end is separated from the cover or the housing by a certain distance. In the height direction, the connecting end is arranged lower than the free end.

According to the foregoing falling film evaporator, the flow guide portion of the flow guide member is generally flat plate-shaped.

According to the foregoing falling film evaporator, a liquid discharge hole is provided on the flow guide member, and the liquid discharge hole is arranged close to the connecting end.

According to the foregoing falling film evaporator, the flow guide member further comprises a connecting portion, the connecting portion is connected to the flow guide portion, and the flow guide member is connected to the housing or the cover by the connecting portion.

According to the foregoing falling film evaporator, the housing comprises a side portion, and the plurality of flow guide members are connected to the side portion.

According to the foregoing falling film evaporator, the plurality of flow guide members are formed by extending along the length direction.

The falling film evaporator in the present application has the advantage of being high in gas-liquid separation efficiency, and the machining process of the flow guide members of the falling film evaporator is simple.

Other features, advantages, and embodiments of the present application may be set forth or become apparent by consideration of the following specific implementations, accompanying drawings, and claims. In addition, it should be understood that the foregoing summary of the invention and the following detailed description of embodiments are exemplary and are intended to provide further explanation without limiting the scope of the present application as claimed. However, the specific implementations and specific examples indicate only preferred embodiments of the present application. Various changes and modifications within the spirit and scope of the present application will become apparent to those skilled in the art from the specific implementations.

BRIEF DESCRIPTION OF THE DRAWINGS

The features and advantages of the present application can be better understood by reading the following detailed description with reference to the accompanying drawings. In the whole accompanying drawings, identical reference numerals represent identical components, wherein.

DETAILED DESCRIPTION OF EMBODIMENTS

Various specific implementations of the present invention will be described below with reference to the accompanying drawings, which constitute a part of the present specification. It should be understood that although terms representing directions, such as "front," "back," "upper," "lower," "left," "right," and other directional or orientational words, are used in the present invention to describe various example structural parts and elements of the present invention, these terms are used herein only for convenience of description, and are determined based on example orientations shown in the accompanying drawings. Since the embodiments disclosed in the present invention may be provided according to different directions, these terms representing directions are only for description and should not be regarded as limitation. In the following accompanying drawings, identical reference numbers are used for identical components, and similar reference numbers are used for similar components.

Figure 1:
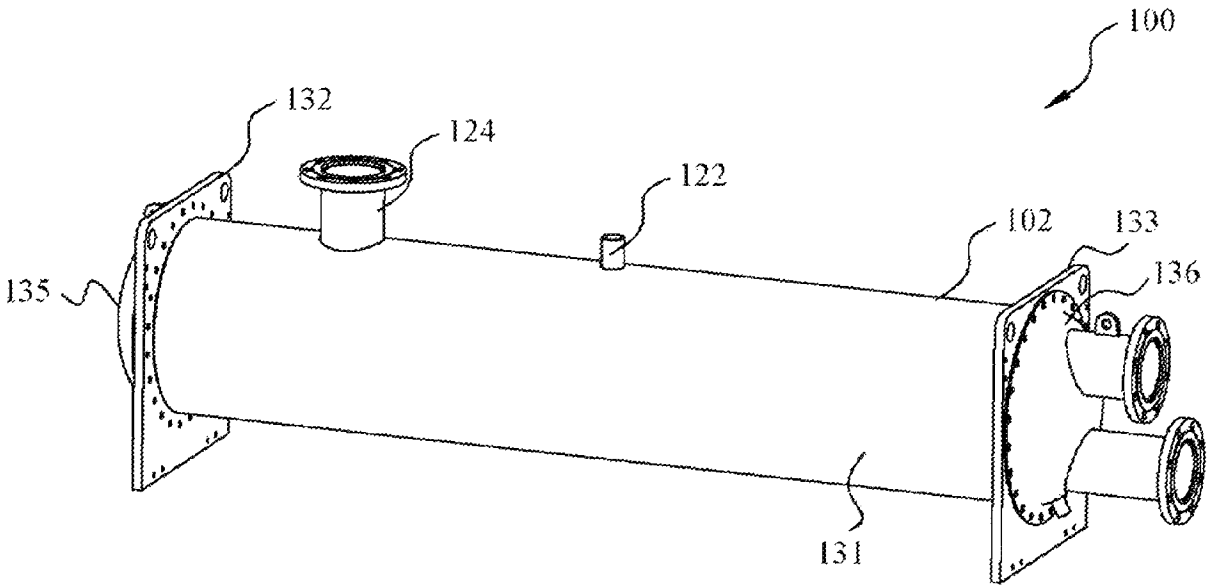
FIG. 1 is a perspective view of a falling film evaporator of the present application.
Figure 2:
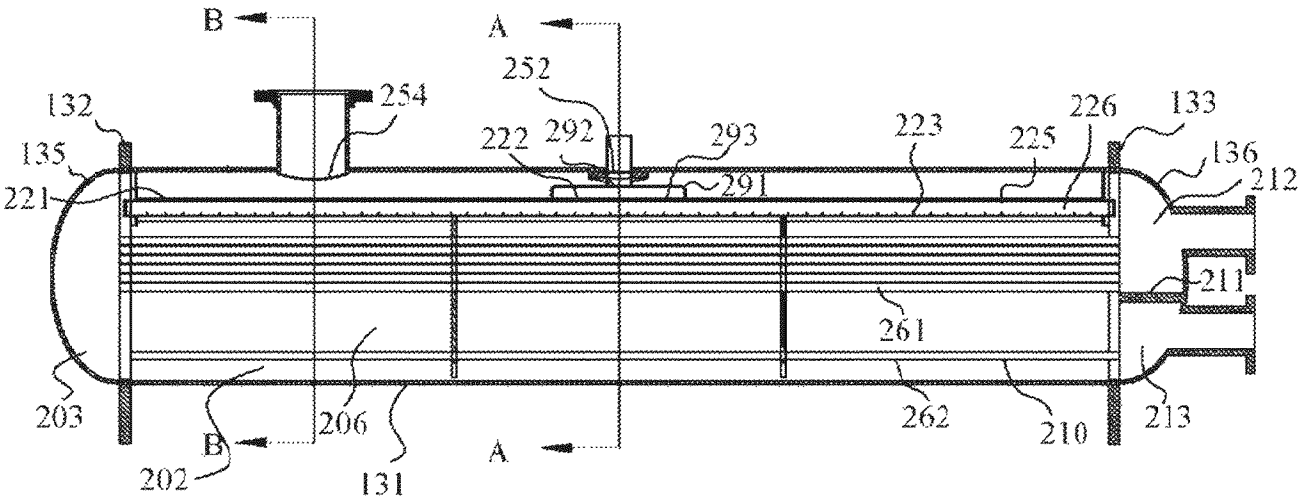
FIG. 2 is an axial cross-sectional view of the falling film evaporator shown in FIG. 1.
Figure 3:
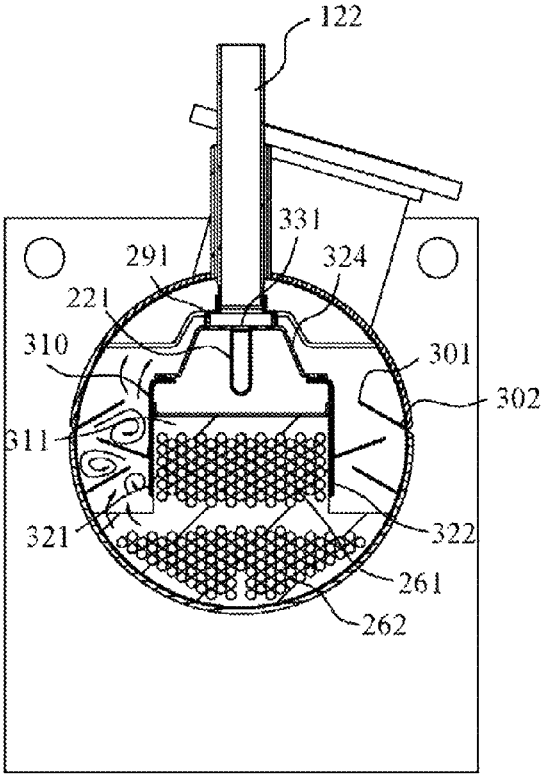
FIG. 3 is a cross-sectional view of the falling film evaporator shown in FIG. 1 along Line A-A in FIG. 2.
Figure 4:
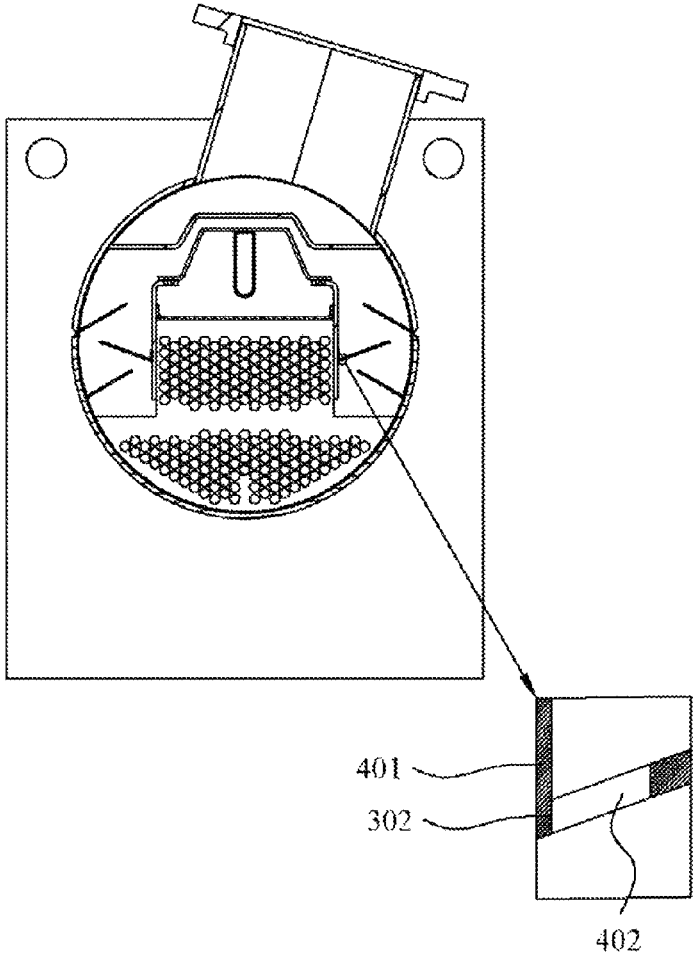
FIG. 4 is a cross-sectional view of the falling film evaporator shown in FIG. 1 along Line B-B in FIG. 2.

FIG. 1 is a perspective view of a falling film evaporator 100 of the present application, FIG. 2 is an axial cross-sectional view of the falling film evaporator 100 shown in FIG. 1, FIG. 3 is a cross-sectional view of the falling film evaporator 100 shown in FIG. 1 along Line A-A in FIG. 2, and FIG. 4 is a cross-sectional view of the falling film evaporator 100 shown in FIG. 1 along Line B-B in FIG. 2, to illustrate a specific structure of the falling film evaporator 100.

As shown in FIGS. 1-2, the falling film evaporator 100 comprises a housing 102. The housing 102 comprises a cylinder 131, a left tube plate 132, a right tube plate 133, a left water tank 135, and a right water tank 136. Here, the cylinder 131 is formed by extending along a length direction of the falling film evaporator 100. The left and right ends of the cylinder 131 are respectively closed by the left tube plate 132 and the right tube plate 133, to form an accommodating cavity 202. The left water tank 135 is arc-shaped, and the left water tank 135 is connected to the left tube plate 132 to form a communicating cavity 203. The right water tank 136 is also arc-shaped, and the right water tank 136 is connected to the right tube plate 133. The right tube plate 133 further comprises a horizontal tube plate 211 extending horizontally from the right tube plate 133 to the right water tank 136, thereby forming an outlet accommodating cavity 212 and an inlet accommodating cavity 213. A liquid inlet 252 and a gas outlet 254 are provided at the upper portion of the cylinder 131. In a length direction of the housing 102, the gas outlet 254 is located at the left portion of the housing 102, and the liquid inlet 252 is located at the middle portion of the housing 102. An inlet tube 122 and an outlet tube 124 are respectively formed by extending upwards from edges of the liquid inlet 252 and the gas outlet 254.

As shown in FIGS. 1-3, the falling film evaporator 100 further comprises a fluid guide structure. The fluid guide structure is provided in the accommodating cavity 202 to guide a flow path of a liquid refrigerant flowing in from the inlet tube 112. Specifically, the fluid guide structure comprises a cover 310, an inlet tube expander 291, and a distributor 221. As shown in FIG. 3, the cover 310 comprises a first plate 321 and a second plate 322 which are oppositely arranged, and a third plate 324. As shown in FIGS. 3-4, the first plate 321 and the second plate 322 are roughly straight plates. In a radial cross section of the housing 102, the third plate 324 is roughly in a shape of a step with lower ends and a higher middle. The first plate 321, the second plate 322, and the third plate 324 are all formed by extending along the length direction of the housing 102. The cover 310 defines a cover accommodating cavity 311. The cover accommodating cavity 311 has a lower cover opening located below and an upper cover opening 331 located on the top of the third plate 324. The inlet tube expander 291 is provided above the cover 310.

As shown in FIGS. 2-3, the inlet tube expander 291 is provided in the accommodating cavity 202 and is provided at the upper portion of the cover accommodating cavity 311. More specifically, the inlet tube expander 291 is provided on the upper cover opening 331 in a covering manner and is connected to the inlet tube 112 and the third plate 324. Specifically, the inlet tube expander 291 has a tube diameter that is larger than that of the inlet tube 112. The inlet tube expander 291 has an opening 292 located at the upper portion and an opening 293 located at the lower portion. The opening 292 at the upper portion is in communication with the liquid inlet 252. The opening 293 at the lower portion is in communication with the upper cover opening 331. Thus, a flow velocity of a fluid flowing in from the inlet tube 112 is capable of being reduced in the inlet tube expander 291.

As shown in FIGS. 2-3, the distributor 221 is provided in the cover accommodating cavity 311 and is provided below the third plate 324. The distributor 221 comprises a distributor housing 225, which defines a distributor accommodating cavity 226. The distributor housing 225 is formed by extending roughly along the length direction of the housing 102. A distributor inlet 222 is provided at the upper portion of the distributor housing 225. Specifically, the distributor inlet 222 is roughly provided at the middle portion along the length direction of the housing 102, and is provided below the upper cover opening 331 on a main baffle assembly 231, such that the fluid is capable of passing through the upper cover opening 331 and the distributor inlet 222 to flow into the distributor accommodating cavity 226. A plurality of distributor outlets 223 are provided at the lower portion of the distributor housing 225. Specifically, the plurality of distributor outlets 223 are arranged at intervals along the length direction of the housing 102, thereby enabling the fluid flowing in the distributor accommodating cavity 226 to be capable of flowing along the length direction of the housing 102 and passing through the distributor outlets 223 to flow into the cover accommodating cavity 311. In an example of the present application, the distributor outlets 223 are in a shape of a narrow strip. However, those skilled in the art can understand that the distributor outlets 223 may be in any shape.

As shown in FIGS. 2-4, the falling film evaporator 100 further comprises a heat exchange tube bundle 210. The heat exchange tube bundle 210 comprises a first group of heat exchange tubes 261 and a second group of heat exchange tubes 262. The first group of heat exchange tubes 261 is roughly arranged in the cover accommodating cavity 311 and is formed by extending along the length direction of the housing 102. The left ends of heat exchange tubes in the first group of heat exchange tubes 261 are in communication with the communicating cavity 203 on the left side of the falling film evaporator 100, and the right ends of the heat exchange tubes in the first group of heat exchange tubes 261 are in communication with the outlet accommodating cavity 212 on the right side of the falling film evaporator 100. The second group of heat exchange tubes 262 is roughly arranged at the lower portion of the accommodating cavity 202 and is formed by extending along the length direction of the housing 102. The left ends of heat exchange tubes in the second group of heat exchange tubes 262 are in communication with the communicating cavity 203 on the left side of the falling film evaporator 100, and the right ends of the second group of heat exchange tubes 262 are in communication with the inlet accommodating cavity 213 on the right side of the falling film evaporator 100. In this way, a heat exchange fluid can enter the falling film evaporator 100 from the inlet accommodating cavity 213 on the right side of the falling film evaporator 100, sequentially flow through the second group of heat exchange tubes 262, the communicating cavity 203, and the first group of heat exchange tubes 261, and then flow out of the falling film evaporator 100 from the outlet accommodating cavity 212. When flowing in the first group of heat exchange tubes 261 and the second group of heat exchange tubes 262, the heat exchange fluid is capable of exchanging heat with a fluid in a second accommodating cavity 206.

Although the first group of heat exchange tubes 261 and the second group of heat exchange tubes 262 are arranged in the falling film evaporator 100 of the embodiment of the present application, in other embodiments, the falling film evaporator 100 may have only the first group of heat exchange tubes 261 or the second group of heat exchange tubes 262 arranged in the accommodating cavity 202.

As shown in FIGS. 3-4, a gas flow channel is arranged between the housing 102 and the cover 310, and is capable of enabling the lower cover opening to be in communication with the gas outlet 254. More specifically, the cylinder 131 has a top portion, a side portion, and a bottom portion. The gas flow channel is arranged between the side portion of the cylinder and the cover 310. A plurality of flow guide members are arranged in the gas flow channel. In the height direction of the housing 102, one of two adjacent flow guide members is connected to the housing 102 and is separated from the cover 310 by a certain distance. The other one is connected to the cover 310 and is separated from the housing 102 by a certain distance. In the height direction of the housing 102, two adjacent flow guide members at least partially overlap. Each flow guide member comprises an overlapping portion and a non-overlapping portion. Here, the overlapping portion is a portion that overlaps an adjacent flow guide member in the height direction. The non-overlapping portion is a portion that does not overlap an adjacent flow guide member in the height direction. An area of the overlapping portion is larger than that of the non-overlapping portion, thereby enabling airflow to go through a longer flow path in a process of flowing from the lower cover opening to the gas outlet 254. Each flow guide member further comprises a flow guide portion and a connecting portion 401. The flow guide portion is connected to the connecting portion 401, and the connecting portion 401 is used for being connected to the housing 102 or the cover 310. The flow guide portion has a free end 301 and a connecting end 302. The connecting end is provided close to the connecting portion 401, for being connected to the housing 102 or the cover 310. The free end 301 is used for being separated from the cover 310 or the housing 102 by a distance. The flow guide member is arranged obliquely. More specifically, the connecting end 302 is arranged lower than the free end 301. As shown in FIG. 4, a liquid discharge hole 402 is provided on the flow guide member, penetrates through the flow guide member along the height direction, and is arranged close to the connecting end 302.

In the embodiment of the present application, in the height direction of the housing 102, three layers of flow guide members are arranged in the gas flow channel. Here, flow guide members at the uppermost layer are connected to the housing 102 and are separated from the cover 310 by a certain distance, thereby forming first openings. Flow guide members at the second layer are connected to the cover 310 and are separated from the housing 102 by a certain distance, thereby forming second openings. Flow guide members at the lowermost layer are connected to the housing 102 and are separated from the cover 310 by a certain distance, thereby forming third openings. The flow guide portion and the connecting portion 401 are formed by bending plates. The flow guide portion is roughly flat plate-shaped.

A flow path of a refrigerant in the falling film evaporator 100 when the falling film evaporator 100 is in a working mode is described below in conjunction with the arrows in FIG. 3.

As shown in FIG. 3, when the falling film evaporator 100 is in the working mode, the liquid refrigerant flows into the falling film evaporator 100 from the inlet tube 112. The liquid refrigerant then sequentially passes through the inlet tube expander 291, the upper cover opening 331 on the cover 310, and the distributor inlet 222 to flow into the distributor accommodating cavity 226 of the distributor 221. Since the distributor accommodating cavity 226 extends along the length direction of the housing 102, the liquid refrigerant accommodated in the distributor accommodating cavity 226 also moves along the length direction of the housing 102. That is to say, in the length direction of the housing 102, the liquid refrigerant flows from the middle portion to the two sides. In a flow process, since the plurality of distributor outlets 223 are provided at the lower portion of the distributor 221, the liquid refrigerant flows downwards. It can be seen that since the plurality of distributor outlets 223 are arranged along the length direction of the housing 102, the liquid refrigerant is capable of flowing downwards in the length direction of the housing 102 in a relatively uniform manner, and flowing through the first group of heat exchange tubes 261 from top down. A heat exchange fluid at a relatively high temperature flows in the first group of heat exchange tubes 261. The liquid refrigerant contacts the first group of heat exchange tubes 261 and exchanges heat with the heat exchange fluid in the first group of heat exchange tubes 261. Specifically, in a process that the liquid refrigerant flows downwards to contact the first group of heat exchange tubes 261, the liquid refrigerant is distributed to the heat exchange tubes at the uppermost row, and a liquid film is formed on the heat exchange tubes at the uppermost row for evaporation. The unevaporated liquid refrigerant drops to heat exchange tubes at the next row for continued evaporation. The liquid refrigerant can keep flowing downwards, and a liquid film is formed on the first group of heat exchange tubes 261 for evaporation. The liquid refrigerant that does not evaporate on the first group of heat exchange tubes 261 flows downwards to contact the second group of heat exchange tubes 262, and exchanges heat with the heat exchange fluid in the second group of heat exchange tubes 262, the temperature rises, and the liquid refrigerant evaporates. A gas refrigerant after evaporating into gas carries unevaporated liquid droplets to flow toward the two sides, forming vortices after hitting the housing 102 and the flow guide members at the lowermost portion and before passing through the third openings. In the vortices, the gas refrigerant carries the unevaporated liquid droplets to rotate. Since inertia of movement of liquid is greater than that of gas, the liquid is easily thrown out of the vortices, thereby deviating from a movement direction of the gas. That is to say, in a process of the vortices, the gas refrigerant is separated from one part of the liquid refrigerant. Then, the gas refrigerant carries the liquid to pass through the third openings upwards and enter spaces enclosed by the flow guide members at the second layer and the flow guide members at the lowermost portion. In the spaces, vortices are also formed, thereby further enabling one part of the liquid to deviate from the gas refrigerant. Then, the gas refrigerant carries the liquid to pass through the second openings upwards and enter spaces enclosed by the flow guide members at the first layer and the flow guide members at the second layer. Similarly, in the spaces, vortices are also formed, thereby further enabling one part of the liquid to deviate from the gas refrigerant. At this point, the process of gas-liquid separation has been completed three times, and the gas refrigerant carries relatively few liquid droplets. Then, the gas refrigerant flows upwards, and finally flows out of the falling film evaporator 100 via the gas outlet 254.

When the gas refrigerant carries the liquid to flow in the vortices, the separated liquid is capable of dropping onto the flow guide members under the action of gravity, passing through the liquid discharge holes 402 in the flow guide members to flow downwards, and finally dropping to the bottom of the accommodating cavity 202.

Figure 5:
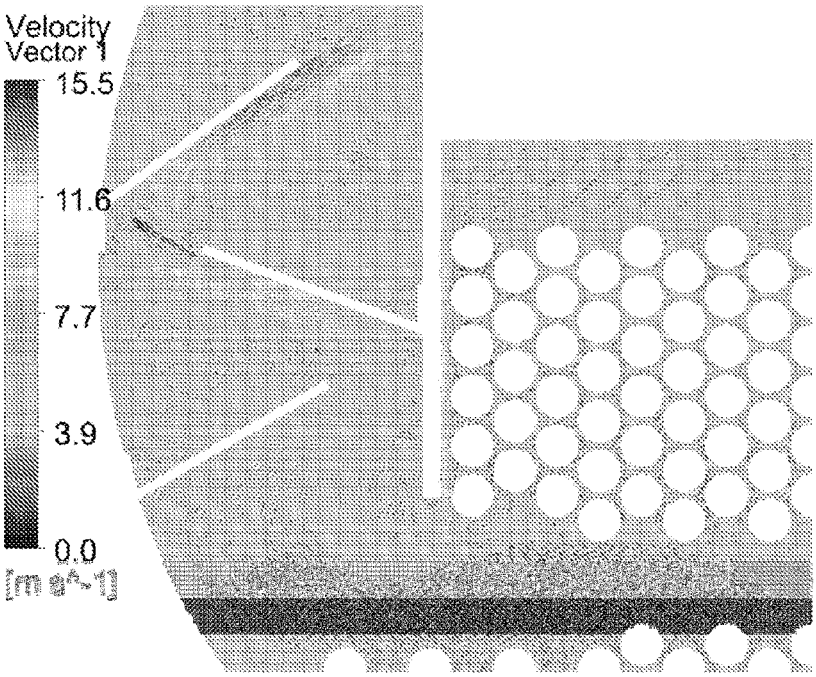
FIG. 5 is a simulation diagram of flow of a refrigerant in the falling film evaporator of the present application.

FIG. 5 is a simulation diagram of flow of a refrigerant in the falling film evaporator 100 of the present application. It can be seen from FIG. 4 that vortices are capable of being formed between adjacent flow guide members on the two sides. In addition, since the left sides of the flow guide members at the lowermost portion are connected to the housing 102 and are separated from the cover 310 by a distance, vortices can also be formed in a space enclosed by the cover 310 and the flow guide members at the lowermost portion.

The falling film evaporator 100 of the present application has the advantage of being high in gas-liquid separation efficiency. Specifically, in the prior art, baffles are arranged between the housing and the cover, there are diverse and inconsistent machining forms for baffles, and a relatively large space is taken up for arrangement. In the case where existing gas-liquid separation efficiency is not high, if an improvement is expected, a larger space is required to allow more baffles to be provided. However, in the present application, a plurality of flow guide members are arranged in the falling film evaporator 100, thereby generating fluid vortices and achieving the object of centrifugal separation. Moreover, openings for circulation (for example, the first openings, the second openings, and the third openings) are arranged along the height direction in a staggered manner. In this way, a longer gas flow channel is capable of being formed, and a movement direction of the refrigerant gas is changed by approximately 180 degrees between each layer of flow guide members (for example, changing from flowing to the upper left to flowing to the upper right), thereby improving a gas separation effect. Therefore, the falling film evaporator 100 of the present application is capable of improving the gas separation effect without changing the size of an existing space.

In addition, the machining process of each flow guide member in the falling film evaporator 100 of the present application is simple. Specifically, each flow guide member comprises a connecting portion and a flow guide portion. The connecting portion 401 is used for being connected to the housing 102 or the cover 310. As an example, the connecting portion 401 is connected to the falling film evaporator 100 by welding. It has a simple structure and can be implemented by a simple bending process.

Although only some features of the present application have been illustrated and described herein, various improvements and changes may be made by those skilled in the art. Therefore, it should be understood that the appended claims are intended to cover all the foregoing improvements and changes that fall within the substantive spirit and scope of the present application.

The invention claimed is:

1. A falling film evaporator, wherein the falling film evaporator comprises:

a housing, the housing having a length direction and a height direction, and the housing defining an accommodating cavity;

a gas outlet, the gas outlet being provided at an upper portion of the accommodating cavity;

a cover, the cover being provided in the accommodating cavity and defining a cover accommodating cavity, the cover accommodating cavity having a lower cover opening, and the cover accommodating cavity being configured to accommodate at least one part of a heat exchange tube bundle;

a gas flow channel, the gas flow channel being located between the housing and the cover and enabling the lower cover opening of the cover accommodating cavity to be in communication with the gas outlet; and a plurality of flow guide members, the plurality of flow guide members being arranged in the gas flow channel along the height direction of the housing, wherein, in the height direction of the housing, one of two adjacent flow guide members is connected to the housing and is separated from the cover by a first distance, and the other of the two adjacent flow guide members is connected to the cover and is separated from the housing by a second distance, and wherein each flow guide member of the plurality of flow guide members comprises a flow guide portion, the flow guide portion has a free end and a connecting end, the connecting end is connected to the housing or the cover, and, in the height direction, the connecting end is arranged lower than the free end.

2. The falling film evaporator of claim 1, wherein:

in the height direction of the housing, the two adjacent flow guide members at least partially overlap.

3. The falling film evaporator of claim 2, wherein:

each flow guide member of the plurality of flow guide members comprises an overlapping portion and a non-overlapping portion, the overlapping portion is a portion that overlaps an adjacent flow guide member in the height direction, and an area of the overlapping portion is larger than that of the non-overlapping portion.

4. The falling film evaporator of claim 1, wherein:

lowermost flow guide members of the plurality of flow guide members are connected to the housing and are separated from the cover by a distance.

5. The falling film evaporator of claim 1, wherein:

the free end is separated from the cover or the housing by the first distance or the second distance.

6. The falling film evaporator of claim 1, wherein:

the flow guide portion is generally flat plate-shaped.

7. The falling film evaporator of claim 1, wherein:

each flow guide member of the plurality of flow guide members comprises a liquid discharge hole provided on the flow guide member, and the liquid discharge hole is arranged close to the connecting end.

8. The falling film evaporator of claim 1, wherein:

each flow guide member of the plurality of flow guide members further comprises a connecting portion, the connecting portion is connected to the flow guide portion, and the flow guide member is connected to the housing or the cover by the connecting portion.

9. The falling film evaporator of claim 1, wherein:

the housing comprises a side portion, and the plurality of flow guide members are connected to the side portion.

10. The falling film evaporator of claim 1, wherein:

the plurality of flow guide members extend along the length direction.

11. A falling film evaporator, comprising:

a housing having a length direction and a height direction, wherein the housing defines an accommodating cavity;

a gas outlet provided at an upper portion of the accommodating cavity;

a cover provided in the accommodating cavity, wherein the cover defines a cover accommodating cavity, the cover accommodating cavity has a lower cover opening, and the cover accommodating cavity is configured to accommodate at least a part of a heat exchange tube bundle;

a gas flow channel located between the housing and the cover, wherein the gas flow channel enables the lower cover opening of the cover accommodating cavity to be in communication with the gas outlet; and a plurality of flow guide members arranged in the gas flow channel along the height direction of the housing, wherein, in the height direction of the housing, one of two adjacent flow guide members is connected to the housing and is separated from the cover by a first distance, and the other of the two adjacent flow guide members is connected to the cover and is separated from the housing by a second distance, and wherein each flow guide member of the plurality of flow guide members extends from the housing or the cover at an oblique angle relative to the height direction of the housing.

12. The falling film evaporator of claim 11, wherein:

in the height direction of the housing, the two adjacent flow guide members at least partially overlap.

13. The falling film evaporator of claim 11, wherein:

each flow guide member of the plurality of flow guide members comprises a flow guide portion, the flow guide portion has a free end and a connecting end, the connecting end is connected to the housing or the cover, and the flow guide portion extends at the oblique angle such that, in the height direction, the connecting end is arranged lower than the free end.

14. The falling film evaporator of claim 13, wherein:

each flow guide member of the plurality of flow guide members comprises a liquid discharge hole provided on the flow guide member, and the liquid discharge hole is arranged close to the connecting end.

15. The falling film evaporator of claim 11, wherein the cover comprises:

a first plate, a second plate, and a third plate extending along the length direction of the housing, wherein the first plate, the second plate, and the third plate define the cover accommodating cavity.

* * * * *